US006135827A

United States Patent [19]

Okabe et al.

[11] Patent Number: 6,135,827

[45] Date of Patent: Oct. 24, 2000

[54] PRESS CONNECTING ELECTRICAL CONNECTOR WITH PARTITION WALLS HIGHER THAN TERMINAL

[75] Inventors: Toshiaki Okabe; Yuji Hatagishi, both of Shizuoka, Japan

[73] Assignee: Yazaki Corporation, Tokyo, Japan

[21] Appl. No.: 09/086,069

[22] Filed: May 29, 1998

[30] Foreign Application Priority Data

May 29, 1997 [JP] Japan ..... 9-140235

[51] Int. Cl.[7] ..... H01R 13/514

[52] U.S. Cl. ..... 439/731; 439/398

[58] Field of Search ..... 439/731, 687, 439/696, 934, 465, 468, 467, 404; 29/857, 858, 861, 863, 865–867

[56] References Cited

U.S. PATENT DOCUMENTS

| | | | |
|---|---|---|---|
| 4,153,326 | 5/1979 | Frantz et al. | 439/293 |
| 4,296,988 | 10/1981 | Warner | 439/398 |
| 4,797,119 | 1/1989 | Miyazawa et al. | 439/395 |
| 5,380,220 | 1/1995 | Okabe | 439/456 |
| 5,415,562 | 5/1995 | Matsumoto et al. | 439/397 |
| 5,575,061 | 11/1996 | Tsuji et al. | 29/863 |

*Primary Examiner*—Brian Sircus
*Assistant Examiner*—Michael C. Zarroli
*Attorney, Agent, or Firm*—Sughrue, Mion, Zinn, Macpeak & Seas, PLLC

[57] ABSTRACT

A press-connecting connector housing in which insulating sheathed wires are press-connected by a press-connecting device is disclosed. The connector housing comprises a pair of opposed side walls, a notch provided respective upper portion of inside the side wall, and receiving the press-connecting device when the insulating sheathed wires are press-connected, an outer peripheral wall provided respective upper portion of the side wall, a partition wall defining at least two cavities inside the side walls, and a terminal accommodated within the respective cavity, the top end of the terminal is lower than the top face of the partition wall and is higher than the bottom face of the notch, wherein, the outermost top end portion of the terminal is supported by the press-connecting device when the insulating sheathed wires are press-connected.

12 Claims, 4 Drawing Sheets

PRESS CONNECTING ELECTRICAL CONNECTOR WITH PARTITION WALLS HIGHER THAN TERMINAL

BACKGROUND OF THE INVENTION

1. Field of the Invention

The present invention relates to a connector housing in which press-connecting connectors of small-size, narrow-pitch type are mounted.

2. Background of the Related Art

FIG. 4 is a cross-sectional view showing a condition before a conductor is press-connected to a press-connecting terminal mounted in a cavity of the connector housing, and FIG. 5 is a cross-sectional view showing a condition after the conductor is press-connected to the press-connecting terminal. FIG. 6 is a cross-sectional view showing a condition before a conductor is press-connected to a press-connecting terminal mounted in a cavity of the connector housing, and FIG. 7 is a cross-sectional view showing a condition after the conductor is press-connected to the press-connecting terminal.

As shown in FIG. 4, the connector housing includes opposite side walls (not shown) and partition walls 4 which have a height smaller than the height of press-connecting portions of the press-connecting terminal 10, that is, the height of press-connecting blades 11*a* of the press-connecting portions. The cavity 3 is formed between the adjacent partition walls 4, and the press-connecting terminal 10 is mounted therein. Guide plates 32 of a conductor press-connecting device 30 are inserted and abutted respectively against the upper ends of the partition walls 4 forming the cavity 3, and in this condition a press-connecting punch 31 of the conductor press-connecting device 30 is pressed or pushed in a direction of the arrow to thereby press-fit the conductor 20*a* of an insulating sheathed wire 20 into a space between the press-connecting blades 11*a*.

The conductor 20*a* of the insulating sheathed wire 20 is press-fitted, thus press-connected to and held in the space between the press-connecting blades 11*a* of the press-connecting terminal 10, as shown in FIG. 5. Then, the connector housing, in which the conductor 20*a* of each insulating sheathed wire 20 is press-connected to and held between the associated press-connecting blades 11*a* and 11*a*, is sealed by a cover 2 having a rugged inner surface held in contact with the upper surfaces of the outer peripheral walls and the upper surfaces of the partition walls 4.

As shown in FIG. 6, the connector housing includes opposite side walls (not shown) and partition walls 4 which have a height greater than the height of press-connecting portions of the press-connecting terminal 10 (that is, the height of press-connecting blades 11*a* of the press-connecting terminal 10 of the press-connecting portions). The cavity 3 is formed between the adjacent partition walls 4, and the press-connecting terminal 10 is mounted therein. Guide plates 32 of a conductor press-connecting device 30 are inserted and abutted respectively against the upper ends of the partition walls 4 forming the cavity 3, and in this condition a press-connecting punch 31 of the conductor press-connecting device 30 is pressed or pushed in a direction of the arrow to thereby press-fit the conductor 20*a* of an insulating sheathed wire 20 into a space between the press-connecting blades 11*a*.

The conductor 20*a* of the insulating sheathed wire 20, press-fitted, thus press-connected to and held in the space between the press-connecting blades 11*a* of the press-connecting terminal 10, as shown in FIG. 7. Then, the connector housing B, in which the conductor 20*a* of each insulating sheathed wire 20 is press-connected to and held between the associated press-connecting blades 11*a*, is sealed by a cover (not shown) having a rugged inner surface held in contact with the upper surfaces of the outer peripheral walls and the upper surfaces of the partition walls.

In the connector housing (FIGS. 4 and 5), the height of the partition walls (cavity walls) 4 is smaller than the height of the press-connecting blades 11*a* of the press-connecting terminal 10, as described above, and therefore a creeping distance b between the adjacent press-connecting terminals 10 through a gap s between the partition wall 4 and the cover 2 is extremely short. As a result, there have been encountered problems that dew condensation may develop between the press-connecting terminals 10, and that when a foreign matter intrudes into the connector housing, a leakage current can easily develop between the press-connecting terminals, so that the resistance of leakage between the press-connecting terminals is lowered.

In the second conventional connector housing (FIGS. 6 and 7), the height of the partition walls (cavity walls) 4 is larger than the height of the press-connecting blades 11*a* of the press-connecting terminal 10. However, when the glide plates 32 of the conductor press-connecting device 30 are removed, the partition walls (cavity walls) 4 are deformed or tilted away from each other (as indicated by arrows) because of the springback of the press-connecting blades 11*a*. This results in a problem that the conductor 20*a* of the insulating sheathed wire 20 fails to be press-connected to and held between the press-connecting blades 11*a* of the press-connecting terminal 10.

SUMMARY OF THE INVENTION

An object of this present invention is to solve the above problems. More specifically, it is an object of this present invention to provide a connector housing in which the resistance of leakage between press-connecting terminals is enhanced, and also the deformation of partition walls due to the springback of press-connecting blades is prevented.

In order to achieve the above object, according to a first aspect of the present invention, there is provided a press-connecting connector housing in which insulating sheathe d wires are press-connected by a press-connecting device is disclosed. The connector housing comprises a pair of opposed side walls, a notch provided on a respective upper portion of inside the side wall, and receiving the press-connecting device when the insulating sheathed wires are press-connected, an outer peripheral wall provided on a respective upper portion of the side wall, a partition wall defining at least two cavities inside the side walls, and a terminal accommodated within the respective cavity, the top end of the terminal is lower than the top face of the partition wall and is higher than the bottom face of the notch, wherein, the outermost top end portion of the terminal is supported by the press-connecting device when the insulating sheathed wires are press-connected.

According to a second aspect of the present invention, a thickness of that portion of each of the opposite side walls, disposed lower than the notch, is larger than a thickness of the partition walls.

According to a third aspect of the present invention, the opposite side walls each having the notch are the outer peripheral walls, respectively.

According to a fourth aspect of the present invention, the connector housing further comprises a cover sealing the upper portion of the connector housing after the insulating sheathed wires are press-connected, and including a recess which receives that portion of the respective partition wall, upper than the top end of the terminal, and the projections received by the respective notch.

In the present invention, the term "press-connecting portion" means those portions (for example, side walls of the terminal and press-connecting blades) of the press-connecting terminal which receive a pressure when press-fitting a conductor of an insulating wire into the press-connecting terminal.

DETAILED DESCRIPTION OF THE PREFERRED EMBODIMENT

A preferred embodiment of the present invention will now be described with reference to the drawings.

Figure 1:
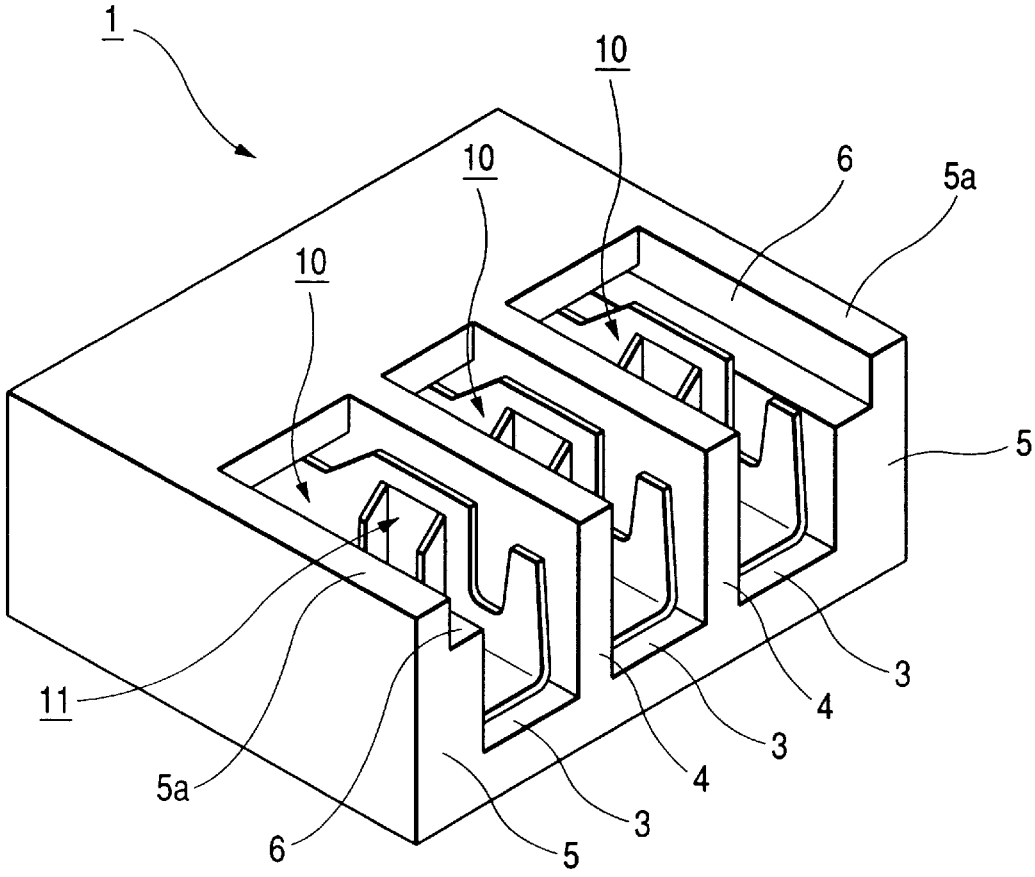
FIG. 1 is a perspective view of one preferred embodiment of a connector housing of the present invention, with a cover removed.
Figure 2:
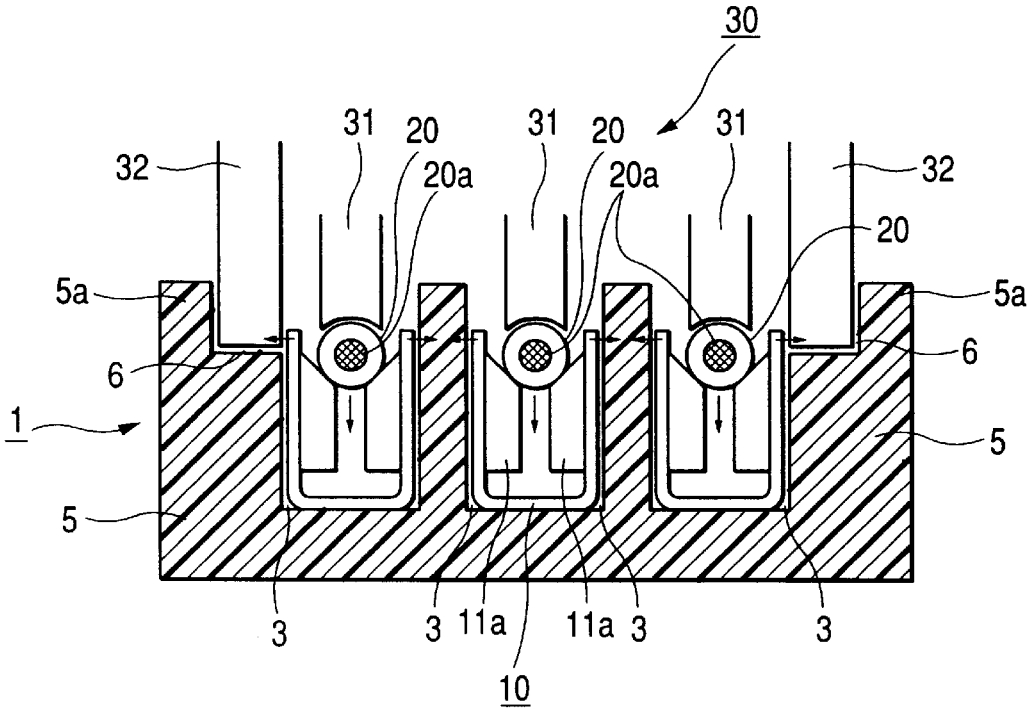
FIG. 2 is a cross-sectional view showing a condition before a conductor is press-connected to each press-connecting terminal mounted in a cavity of the connector housing of the embodiment shown in FIG. 1.
Figure 3:
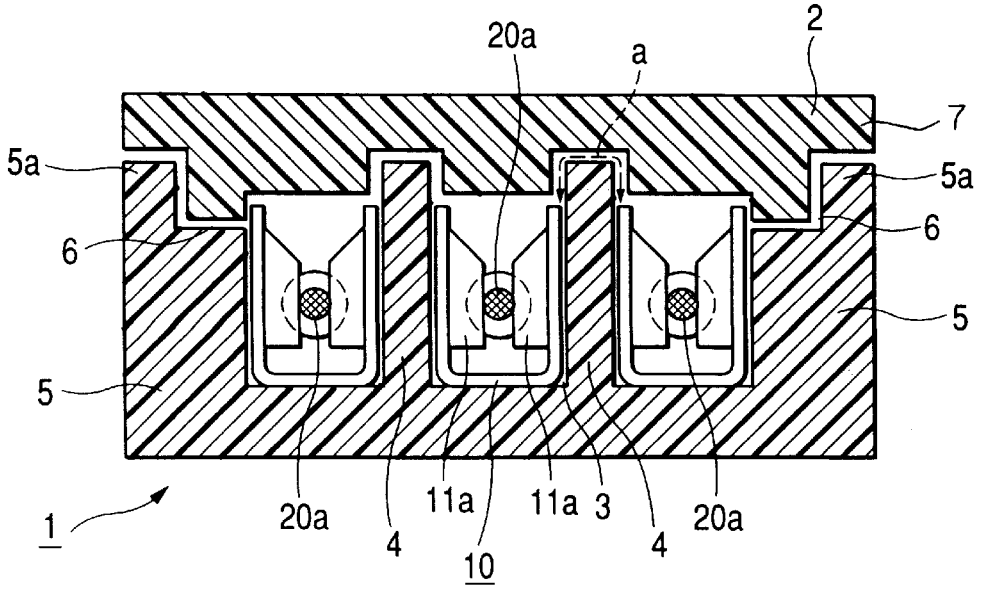
FIG. 3 is a cross-sectional view showing a condition after the conductor is press-connected to the press-connecting terminal.
Figure 4:
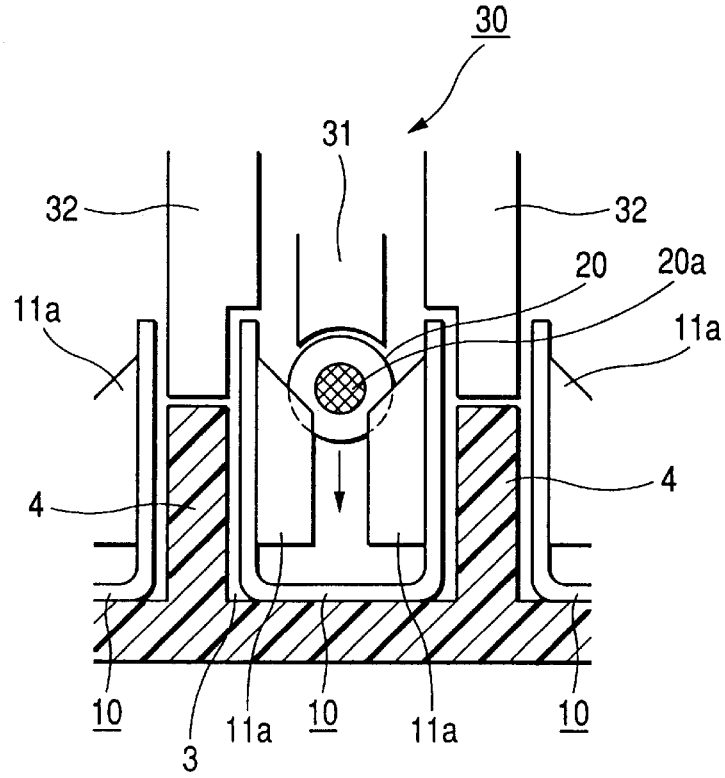
FIG. 4 is a cross-sectional view showing a condition before a conductor is press-connected to a press-connecting terminal mounted in a cavity of a connector housing.

FIG. 1 is a perspective view of one preferred embodiment of a connector housing of the present invention, with a cover removed, FIG. 2 is a cross-sectional view showing a condition before a conductor is press-connected to each press-connecting terminal mounted in a cavity of the connector housing of this embodiment, and FIG. 3 is a cross-sectional view showing a condition after the conductor is press-connected to the press-connecting terminal.

As shown in FIG. 1, a body 1 of the connector housing of the present invention includes opposite side walls 5 and partition walls 4 which have a height which is greater than the height of press-connecting portions 11 of the press-connecting, terminals 10. Cavities 3 are formed between each of the opposite side walls 5 and its adjoining partition wall 4, and also the cavity 3 is formed between the adjacent partition walls 4, and the press-connecting terminals 10 are mounted respectively in the cavities 3.

Notches 6 for allowing the insertion of guide plates of a press-connecting device into respective positions below the upper ends of the press-connecting portions are formed respectively in inner surfaces of the opposite side walls 5. Outer peripheral walls 5*a* are formed respectively at upper end portions of the opposite side walls 5. The thickness of the opposite side walls 5 is greater than the thickness of the partition walls 4 and therefore the opposite side walls 5 have a sufficient strength although the notches 6 are formed respectively in the side walls 5, and also the outer peripheral walls has a sufficient strength.

The guide plates 32 of the conductor press-connecting device 30 are inserted respectively into the notches 6 formed respectively in the opposite side walls 5, as shown in FIG. 2, and in this condition all the conductors 20*a* of insulating sheathed wires 20 are press-fitted respectively into the press-connecting terminals 10 from the upper side of press-connecting blades 11*a* of the pressing-connecting portions at the same time by compression punches 31 of the conductor press-connecting device 30.

In this manner, the conductor 20*a* of each of the insulating sheathed wires 20, press-fitted in a space between the associated press-connecting blades 11*a*, is press-connected to and held between the press-connecting blades 11*a* of the press-connecting terminal 10, as shown in FIG. 3. Then, the connector housing, in which the conductor 20*a* of each of the insulating sheathed wires 20 is press-connected to and held between the associated press-connecting blades 11*a*, is sealed by a cover 2 having a rugged inner surface (having projections and recesses) held in contact with the upper surfaces of the outer peripheral walls 5*a*, the surfaces of the notches 6, the upper surfaces of the partition walls 4, and those portions of opposite side surfaces of the partition walls 4 disposed adjacent to the upper surfaces thereof.

Figure 5:
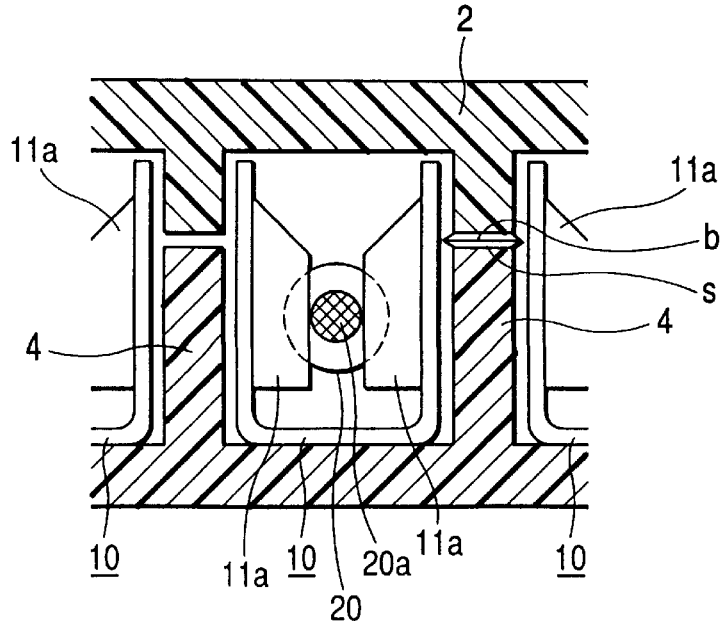
FIG. 5 is a cross-sectional view showing a condition after the conductor is press-connected to the press-connecting terminal of FIG. 4.
Figure 6:
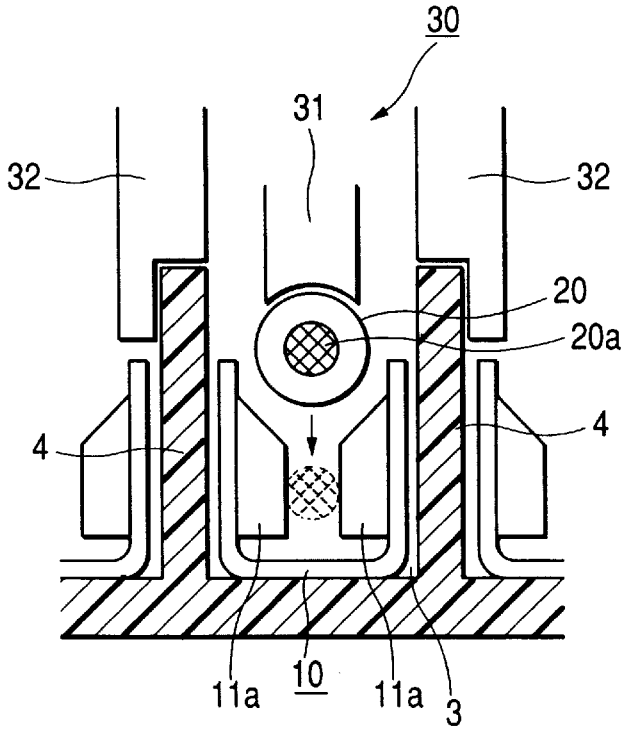
FIG. 6 is a cross-sectional view showing a condition before a conductor is press-connected to a press-connecting terminal mounted in a cavity of a connector housing.
Figure 7:
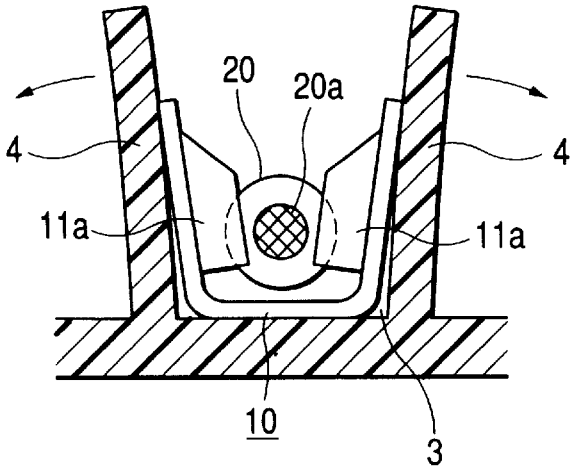
FIG. 7 is a cross-sectional view showing a condition after the conductor is press-connected to the press-connecting terminal of FIG. 6.

According to the present invention, the partition walls have a height larger than the height of the press-connecting portions of the press-connecting terminals, an therefore as shown in FIG. 3, a creeping distance a between the adjacent press-connecting terminals is larger than the creeping distance b (FIG. 5) in the conventional construction, so that the resistance of leakage between the press-connecting terminals is markedly enhanced.

Further, when the conductor is press-fitted between the press-connecting blades of each of the press-connecting terminals mounted respectively in all of the cavities, the total amount of deformation of all of the press-connecting blades is limited, and the adjacent press-connecting blades support each other, so that the angled deformation of the press-connecting blades can be prevented. When the thickness of the opposite side walls is larger than the thickness of the partition walls, the effect of preventing the angled deformation of the press-connecting blades is enhanced. Therefore, there will not be encountered a problem that the partition walls (cavity walls) are deformed or tilted because of the springback of the press-connecting blades, so that the conductor fails to be press-connected to the press-connecting blades of the press-connecting terminals which are adjacent each other.

Still further, the connector housing is sealed by the cover having the rugged inner surface having projections and recesses which are not shown) held in contact with the upper surfaces of the outer peripheral walls, the surfaces of the notches, the upper surfaces of the partition walls, and those portions of the opposite side surfaces of the partition walls disposed adjacent to the upper surfaces thereof, and therefore the resistance of leakage between the adjacent press-connecting terminals is enhanced, and also the angled deformation of the press-connecting blades is prevented.

As has been described heretofore, there can be provided the connector housing in which the resistance of leakage between the press-connecting terminals is enhanced, and also the deformation of the partition walls due to the springback of the press-connecting blades is prevented.

What is claimed is:

1. A connector housing comprising:

a pair of opposed side walls;

an upwardly opened notch provided on a respective upper portion of inside the side wall so as to define an upwardly facing surface;

an outer peripheral wall provided on a respective upper portion of the side wall;

a partition wall defining at least two cavities inside the side walls; and a terminal accommodated within the respective cavity, wherein the top end of the terminal is lower than the top face of the partition will and is higher than the bottom face of the notch.

2. A connector housing comprising:

a pair of opposed side walls;

a notch provided respective upper portion of inside the side wall;

an outer peripheral wall provided respective upper portion of the side wall;

a partition wall defining at least two cavities inside the side walls; and a terminal accommodated within the respective cavity, the top end of the terminal is lower than the top face of the partition wall and is higher than the bottom face of the notch, wherein a thickness of that portion of each of the side walls, disposed lower than the notch, is larger than a thickness of the partition wall.

3. The connector housing as set forth in claim 1, wherein the side walls having the notch are said outer peripheral walls, respectively.

4. The connector housing as set forth in claim 1 further comprising:

a cover sealing the upper portion of the connector housing and including a recess which receives that portion of the respective partition wall, higher than the top end of the terminal, and the projections received by the respective notch.

5. The connector housing as set forth in claim 2 further comprising:

a cover sealing the upper portion of the connector housing and including a recess which receives that portion of the respective partition wall, higher than the top end of the terminal, and the projections received by the respective notch.

6. A press-connecting connector housing in which insulating sheathed wires are press-connected by a press-connecting device comprising:

a pair of opposed side walls;

a notch provided on a respective upper portion of inside the side wall, and receiving the press-connecting device when the insulating sheathe wires are press-connected;

an outer peripheral wall provided on a respective upper portion of the side wall;

a partition wall defining at least two cavities inside the side walls; and a terminal accommodated within the respective cavity, the top end of the terminal being lower than the top face of the partition wall and higher than the bottom face of the notch, wherein, the outermost top end portion of the terminal is supported by the press-connecting device when the insulating sheathed wires are press-connected.

7. The press-connecting connector housing as set forth in claim 6, wherein a thickness of that portion of each of the side walls, disposed lower than the notch, is larger than a thickness of the partition wall.

8. The press-connecting connector housing as set forth in claim 6, wherein the side walls each having the notch are said outer peripheral walls, respectively.

9. The press-connecting connector housing as set forth in claim 6 further comprising:

a cover sealing the upper portion of the connector housing after the insulating sheathed wires are press-connected, and including a recess which receives that portion of the respective partition wall, higher than the top end of the terminal, and the projections received by the respective notch.

10. The press-connecting connector housing as set forth in claim 7 further comprising:

a cover sealing the upper portion of the connector housing after the insulating sheathed wires are press-connected, and including a recess which receives that portion of the respective partition wall, higher than the top end of the terminal, and the projections received by the respective notch.

11. A method for press-connecting insulating sheathed wires to a press-connecting connector housing including a pair of opposed side walls, a notch provided on a respective upper portion of inside the side wall, an outer peripheral wall provided respective upper portion of the side wall, a partition wall defining at least two cavities inside the side walls, and a terminal accommodate within the respective cavity, wherein the top end of the terminal is lower than the top face of the partition wall and is higher than the bottom face of the notch comprising steps of:

inserting a press-connecting device into the respective notch;

supporting the outermost top end portion of the terminal by the press-connecting device; and press-fitting the insulating sheathed wires into the respective terminals at the same time.

12. The method for press-connecting insulating sheathed wires to the press-connecting connector housing as set forth in claim 11 further comprising the step of:

sealing the upper portion of the connector housing with a cover including a recess which receive s that portion of the respective partition wall, higher than the top end of the terminal, and the projections received by the respective notch after the insulating sheathed wires are press-connected.

* * * * *